United States Patent [19]

Knoos

[11] Patent Number: 4,498,295

[45] Date of Patent: Feb. 12, 1985

[54] THERMAL ENERGY TRANSFER SYSTEM AND METHOD

[76] Inventor: Stellan Knoos, 5933 Avenida Chamnez, La Jolla, Calif. 92037

[21] Appl. No.: 406,342

[22] Filed: Aug. 9, 1982

[51] Int. Cl.[3] ..... F02G 1/04

[52] U.S. Cl. ..... 60/517; 60/526; 62/6

[58] Field of Search ..... 60/517, 526; 62/6

[56] References Cited

U.S. PATENT DOCUMENTS 3,845,624 11/1974 Roos ..... 60/517

*Primary Examiner*—Allen M. Ostrager

*Attorney, Agent, or Firm*—Fraser and Bogucki

[57] ABSTRACT

A thermodynamic system for interchanging thermal energy with external sources or sinks while minimizing the dead volume presented to the pressure cycle is based upon a thermodynamic machine which cycles a working fluid bidirectionally through a regenerator means and at least one external heat exchanger for interchanging thermal energy with a heat source or sink. Between the thermodynamic machine and the heat exchanger is a switchable thermal energy storage system using at least one heat load capacitor and two different circulation loops through the storage system. By switching the working fluid paths through the thermal energy storage system, thermal energy is exchanged but the thermodynamic machine is isolated from the heat exchanger at least predetermined intervals during operation, and the dead space in the external device does not affect the pressure cycle of the machine.

34 Claims, 10 Drawing Figures

THERMAL ENERGY TRANSFER SYSTEM AND METHOD

BACKGROUND OF THE INVENTION

Thermodynamic machines, such as energy transfer or heat pump systems using a Stirling, Vuilleumier or other cycle, supply thermal energy, mechanical energy, or refrigeration capacity for external use. A particularly advantageous form of such systems for many heat transfer applications is described in a previously filed application of the present inventor entitled "Unitary Heat Engine/Heat Pump System", Ser. No. 335,659, filed Dec. 30, 1981. In this integrated system, thermal energy output is developed at an intermediate temperature level (e.g. 60° C.-100° C.) with high coefficient of performance. Because the system uses ambient temperature thermal energy as an input (e.g. solar energy, water, ground, or waste energy sources) it is particularly suitable for large (i.e. more than 100 KW) installations. Consequently it is also particularly suitable for large central heating installations.

Most current thermodynamic machines employ a thermal regenerator the conduit for a working fluid being transferred back and forth between a hot working chamber and a cold working chamber. Each of the chambers has a cyclically driven displacer or piston for establishing the pressure-volume changes used in the particular thermodynamic cycle. Thermal regeneration forms a vital part of the process by accepting thermal energy from and returning it back to the working fluid. For heating and refrigeration applications, the working fluid of the cyclically varying thermodynamic system must at some point undergo thermal interchange with an external device or fluid. In the system described in patent application Ser. No. 335,659 mentioned above, for example, heat exchanger couplings may be used in different combinations at the cold, intermediate and hot temperature levels. In a refrigeration system using solar energy input, for example, heat exchangers are used at both the hot and cold ends of the machine to couple working fluid to an external medium. The heat exchanger, usually but not necessarily a countercurrent device, enables efficient access of an exterior source or system to the working fluid within the system. It does, however, introduce a penalty by significantly enlarging the interior volume to be occupied by the working fluid. Thus the "dead space" in the system may be significantly increased, with consequent deterioration of power output and efficiency for systems of the Vuilleumier type. As defined by Walker in the book "Stirling-Cycle Machines", Clarendon Press, Oxford, 1973, pp. 19–20, the dead space for Stirling devices is "that part of the working space not swept by one of the pistons, and includes cylinder clearance spaces, void volumes of the regenerator and other heat-exchangers, and the internal volume of associated ducts and ports." As shown by Walker, supra, at p. 40, there is a significant drop-off in specific power (expressed as a power parameter) or specific heat load with increasing dead space (expressed as a dead-space ratio) for given temperature ratio, swept-volume ratio, and piston lead angle for the Stirling. The same general relationship is recognized as holding true for other thermodynamic cycles as well. In the unitary heat engine/heat pump system, in which three such heat exchangers are used and system performance is strongly affected by thermodynamic considerations, increased dead space can have a strong adverse effect on system performance.

The use of heat exchangers that interchange thermal energy with the working fluid and external systems has heretofore been regarded as introducing unavoidable dead space in thermodynamic machines. The degree of the penalty imposed is unfortunately increased when a system is intended to operate with available, relatively low temperature heat sources, such as solar energy or waste heat, or to provide significant amounts of thermal energy output (e.g. greater than 100 KW) at intermediate temperature levels. In such situations the pressure ratio and temperature ratio of the thermodynamic machine may be relatively low at the outset and the penalty imposed by increasing the dead space may be excessive.

SUMMARY OF THE INVENTION

Thermodynamic machines and methods in accordance with the invention substantially decouple or isolate the working fluid in a thermal regeneration cycle from external thermal energy transfer operations. Small efficient thermal regenerator devices are coupled within the system to define one or more heat load capacitors, and alternately switched between one path in which they are in communication with the thermodynamic process and an external transfer path in which they communicate only with the exterior system. By placing only limited heat load capacitor volume in the regeneration loop at one time, the thermodynamic cycle is isolated from the external thermal transfer system and dead space is minimized even though a large heat exchanger of high efficiency is employed. Switching of the heat load capacitor can be effected at minima in the pressure cycle.

In one particular example of systems and methods in accordance with the invention, a pair of switchable heat load capacitors are coupled in time-dependent communication with the working fluid in a thermodynamic machine. Switchable valves control conduit paths which, at any one time, couple working fluid to one of the heat load capacitors, while the other heat load capacitor, having previously been thermally charged, positively or negatively, is in communication solely with the heat exchanger. Each heat load capacitor is in a given loop for a predetermined integral number of cycles (one or greater). The number of cycles used is proportioned to the size of the heat load capacitor and the amount of thermal energy to be stored. Switching between valve positions to reverse the charge-discharge cycle of the heat load capacitors is efficiently accomplished at low pressure points in the pressure cycle.

With working fluid decoupling systems in accordance with the invention, the minimized dead space in the working fluid path effectively improves the pressure ratio and thermal efficiency of a thermodynamic system incorporating a large heat exchanger of high efficiency. This technique for decoupling the pressure cycle from a heat exchanger which interchanges thermal energy with an external medium may be used either to heat or to cool the working fluid in a system. It is particularly adaptable to, and useful in, systems operating with high thermal outputs, e.g. 100 kilowatts or more, because the valving and thermal storage devices are economically justified by the elimination of dead space.

In accordance with other aspects of the invention, a wide variety of thermal capacitors and switching cycles may be employed where advantageous for particular circumstances. Operation of the thermal load capacitor means may be intermittent, such that a single thermal load capacitor may be employed for charging during one or a sequence of cycles, followed by a dormant or pause period for discharging during which transfer to the associated unit is effected. This arrangement offers some advantages in thermal efficiency over prior art systems even though the operation is not continuous. In accordance with other features, however, more than two heat load capacitors can be utilized in parallel or series-shunt arrangements that fully isolate the pressure cycle from the heat exchanger. In these systems the valving is arranged to charge at least one regenerator in the set while previously charged capacitor means are being discharged. Consequently, it is feasible to control charging of only a part of a thermal capacitor device as well as to vary the cyclic operation to achieve a variety of results.

DETAILED DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
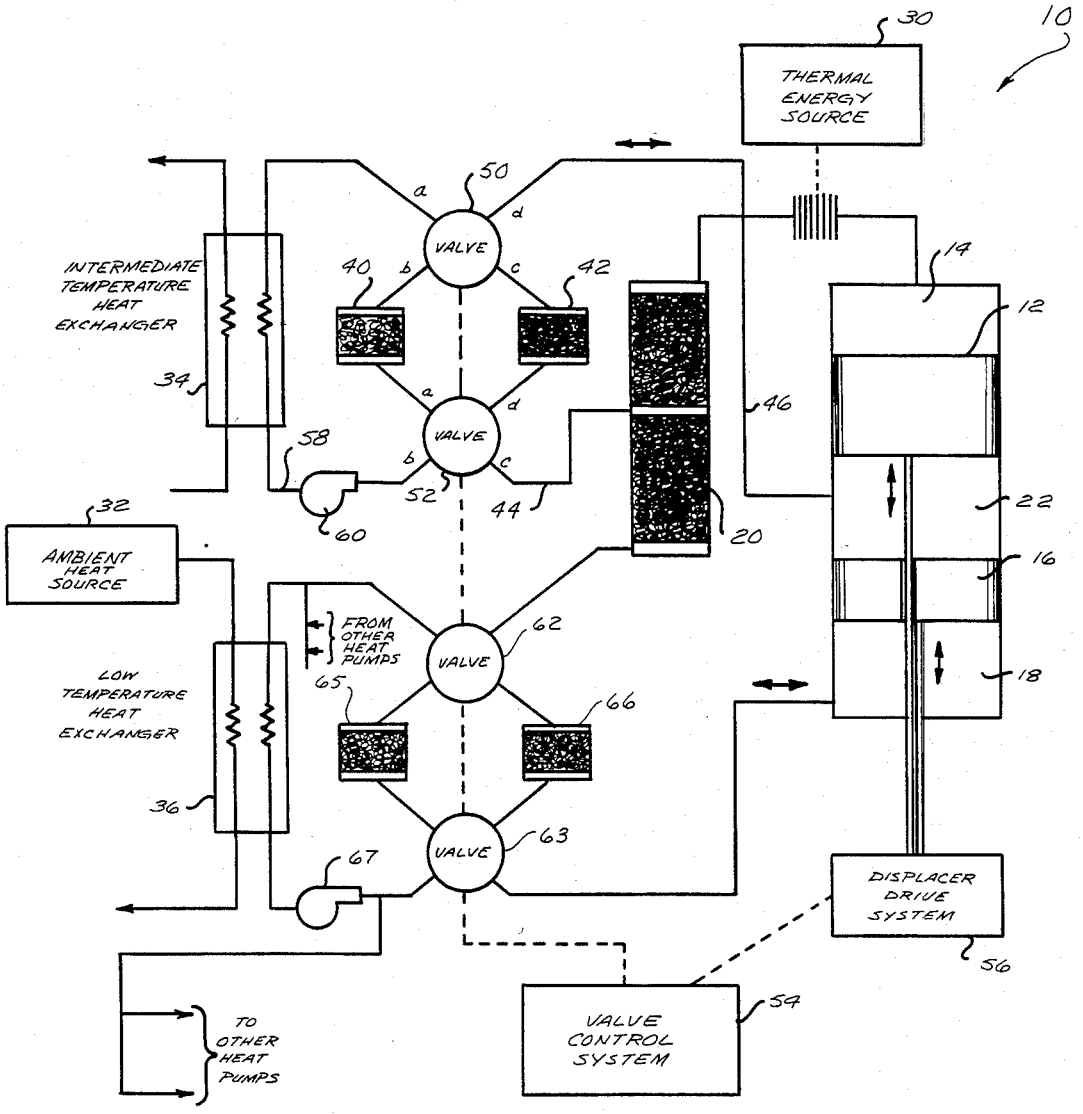
FIG. 1 is a schematic representation of a system in accordance with the invention.

An integral heat engine/heat pump system 10 in accordance with the disclosure of patent application Ser. No. 335,659 referenced above is depicted in FIG. 1 and described hereafter because it provides a particularly advantageous context for usage of the concept of the present invention. In this system 10, a hot displacer 12 within a hot working chamber 14 is operated in phased relation to a cold displacer 16 within a cold working chamber 18. Both working chambers 14, 18 are intercoupled by a regenerator 20, through which working fluid is transported to store and surrender thermal energy as part of the thermodynamic cycle. As described in the prior filed application, however, an intermediate working chamber 22 between the hot and cold displacers 12, 16 respectively is arranged and operated relative to particular parameters of the system such that high thermal output is generated at an intermediate temperature level. Both a high temperature thermal energy source 30 and an ambient heat source 32 contribute to the useful heat output to achieve a significant coefficient of performance for this heat pump system.

Because the system described is particularly suitable for large installations, the use of large, high efficiency heat exchangers 34, 36 in association with the working fluid at the intermediate and cold levels is desirable to transfer thermal energy with an external medium. In this sense they are sometimes referred to hereafter as external heat exchangers even though they contain a part of the working fluid from the thermodynamic process. If the ambient heat source 32, for example, is an ambient ground or water mass, a particularly large low temperature heat exchanger 36 may be utilized. Likewise, if the output of the system is intended to supply central heating for buildings or a number of residences, the intermediate temperature heat exchanger 34 must be large. Although not shown in FIG. 1, the thermal energy source 30 might itself be a high volume structure. In this event another large, high efficiency heat exchanger would be needed to effect thermal energy interchange with the working fluid at the hot working chamber 14. In whatever combination such heat exchangers might be employed, the penalty in dead space could be excessive.

In the present system, however, a heat exchanger that is coupled to an external working medium, such as the intermediate temperature heat exchanger 34, is effectively decoupled from the pressure cycles in the thermodynamic machine by an interconnecting switchable valving system and a pair of relatively small, high efficiency regenerators 40, 42. These regenerators are hereinafter referred to as the first and second heat load capacitors 40, 42, and they are used in alternate charge-discharge relationships as the fluid circuits are varied. The working fluid transferred between the intermediate level of the regenerator 20 and the intermediate working chamber 22 by conduits 44, 46 respectively, is not in direct communication with the intermediate temperature heat exchanger 34, except for the short valve shifting intervals. Instead, the conduits 44, 46 are intercoupled in alternating fashion to the first and second heat load capacitors 40, 42 by a pair of four port, two position valves 50, 52. These valves 50, 52 are operated together by a valve control system 54, and in synchronism with the hot and cold displacers 12, 16 by a coupling from the valve control system 54 to the displacer drive system 56. Of the four ports at each valve 50, 52, at any point in time except during switching two may be said to be external in the sense that they are coupled to the heat exchanger 34, in contrast to the other two which are internal to the cross-coupling for the heat load capacitors 40, 42. One of the couplings to the heat exchanger 34 includes a pump 67 in series relation for maintaining flow in that circulation loop.

A similar switchable heat load capacitor arrangement is utilized in the interchange of energy with the low temperature heat exchanger 36. A second pair of two position valves 62, 63 are coupled between the cold end of the regenerator 20 and the cold working chamber 18 on one side, and across the heat exchanger 36 on the other side. Each valve 62, 63 is controlled by the valve control system 54, to provide alternate charging (and concurrent discharging) of different individual heat load capacitors 65, 66. A pump or blower 67 in the heat exchanger 36 loop maintains flow through the valves 62, 63 and the heat load capacitors 65, 66 associated with it at any given time. The blower 67 may also be used to couple the low temperature heat exchanger 36 to other heat pumps, not shown in detail. Thus the single heat exchanger 36 can provide thermal energy input from the ambient heat source 32 to a number of systems.

Figure 2:
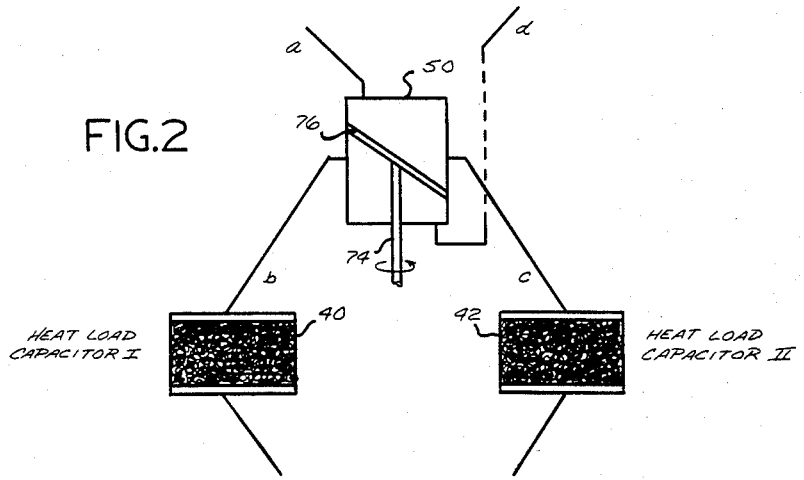
FIG. 2 is a schematic representation of a valving and heat load capacitor arrangement that may be used in the system of FIG. 1.
Figure 3:
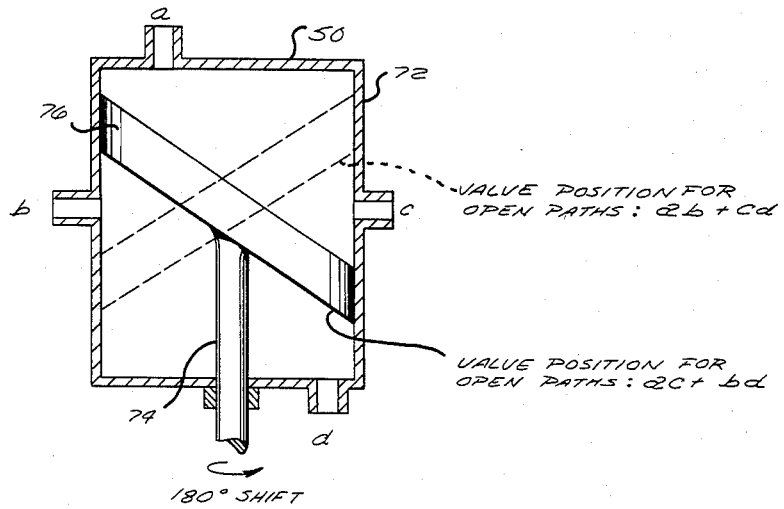
FIG. 3 is another view of the valving device of FIG. 2, showing different conditions of operation.
Figure 4:
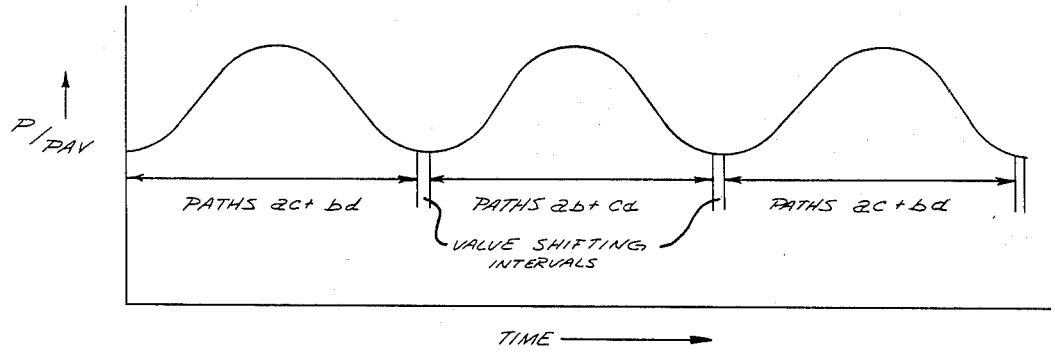
FIG. 4 is a timing diagram showing the relationship of valve switching times to pressure cycle variations in the system of FIG. 1.

The interconnection of two-way valves 50, 52 in controlling the circulation loops for the heat load capacitors 40, 42 may be better understood by reference to the diagram of FIG. 2, the sectional view of the valve of FIG. 3, and the waveform of FIG. 4. The same sequence of operation may be used at the other pair of heat load capacitors 65, 66 so that the detailed description of the low temperature part of the system may be omitted. For ease of reference, the different ports of the valve 50 shown in FIGS. 2 and 3 are designated a, b, c and d respectively, proceeding counterclockwise from the upper left hand corner. The same characterization can be used on the second valve 52 because the valve positions are alike at a given point in time. The valve is a rotary device having a cylindrical body 72 and a valve shaft 74 which, under operation of the valve control system 54, rotates in 180° increments or continuous rotation to shift the position of an angled valve surface 76. In the position shown, the ports that are intercoupled are a-c and b-d. In the alternate position, the open paths are a-b and c-d. Thus, referring again to FIG. 1, for the valve position shown in FIGS. 2 and 3 the loop from the heat exchanger 34 is directed via the conduit 58 and blower 67 through the valve 52 via ports b and d, through the second heat load capacitor 42 to discharge thermal energy previously accumulated therein, and back to the heat exchanger 34 via the ports a and c of the valve 50. Concurrently, charging of the first heat load capacitor 40 from the intermediate level of the regenerator 20 and the intermediate temperature level working chamber 22 is established by the paths a-c of valve 52 and the b and d ports of the valve 50. In the present description a heat load capacitor is referred to as "charged" when it receives a net increase in thermal energy, and "discharged" when returned to its original lower temperature level. A heat load capacitor can thus be charged from either the thermodynamic machine of the associated heat exchanger depending upon whether a heat source or heat sink interchange is being used. As shown in FIG. 4, the valves 50, 52 are switched at minima in the cyclic pressure changes occurring in the intermediate temperature working chamber 22, although the switching can take place at other points in the cycle and the duration of charging can be any integral number of cycles. Shifting of the valve member 76 can be effected by a conventional means such as a rotary solenoid which rotates 180° in opposite or same directions, or by a motor which causes continual rotation of the shaft 74.

In any event, the alternate charging and discharging of the two heat load capacitors 40, 42 in these separate paths, decouples the pressure cycles in the heat engine/-heat pump system 10 from the large interior volume of the heat exchanger 34. The number of cycles of charge and discharge used can be varied in accordance with the thermal capacities of the two heat load capacitors 40, 42, in relation to the total amount of thermal energy that is being transferred.

The same principle is utilized in the heat load capacitor and valving arrangement operated in conjunction with the low temperature heat exchanger 36. It should be noted that the application involves opposite thermal transfer, in that the heat exchanger 36 is the source of thermal energy and that heat is primarily drained from the heat load capacitors 65, 66 to the working gas leaving the cold working chamber 18. The alternation of charge and discharge paths decouples the thermodynamic process from the heat exchanger 36 in the fashion previously described.

Figure 6:
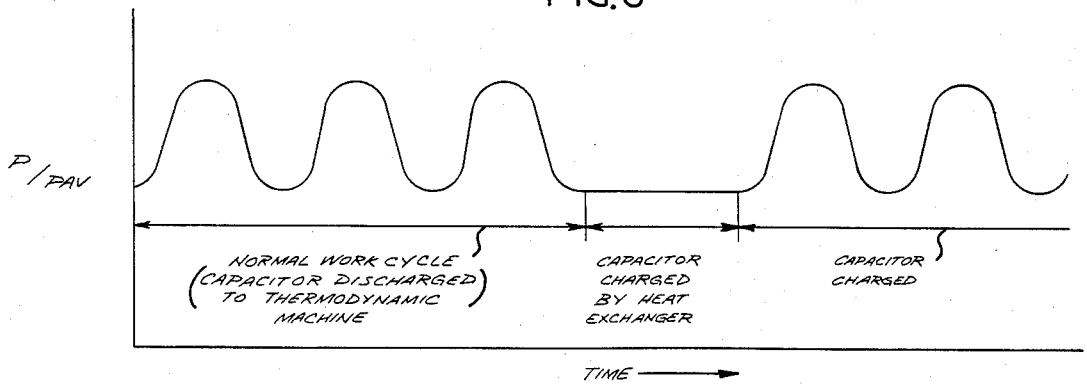
FIG. 6 is a second timing diagram showing different valve switching times relating to pressure cycle variations in the system of FIG. 5.
Figure 5:
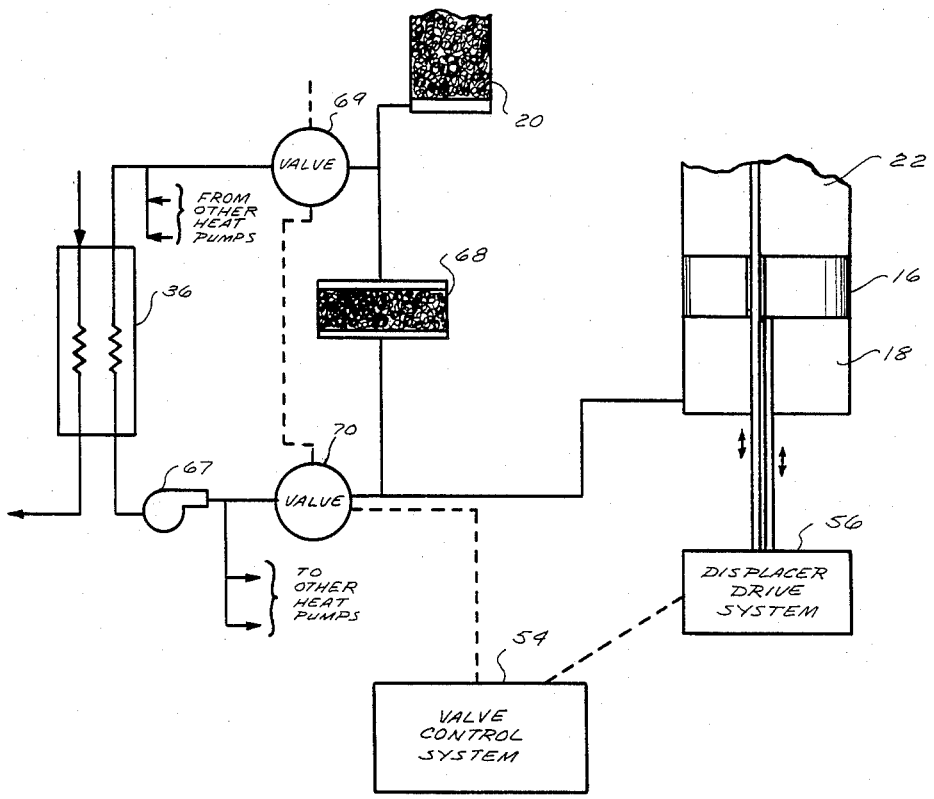
FIG. 5 is a schematic representation of a part of a different system in accordance with the invention using a single heat load capacitor in conjunction with an individual heat exchanger.

A different switchable heat load capacitor arrangement is illustrated in FIG. 5 as it might be used in relation to the low temperature heat exchanger 36. This is a decoupled system using a single heat load capacitor 68 coupled in series between the cold end of the regenerator 20 and the cold working chamber 18. A parallel coupling across the single heat load capacitor 68 is established from the low temperature heat exchanger 36 by conduits including two port, on-off valves 69, 70 controlled by the valve control system 54. The valves 69, 70 when in a first position are open to provide communication between the opposite ends of the heat exchanger 36 and the heat load capacitor 68. In a second position the valves 69, 70 are closed and the heat load capacitor 68 is coupled only between the regenerator 20 and cold working chamber 18. As shown in the timing diagram of FIG. 6, pressure cycling in the thermodynamic system 10 is continuous for a selected number of cycles, here three, in which the valves 69, 70 are closed. During this interval, the heat load capacitor is discharging heat to the working gas while the pressure cycle is decoupled from the low temperature heat exchanger 36. The heat load capacitor 68 is then fully charged during the next full displacer-motion cycle, which is feasible because the heat exchanger 36 can have an extremely large thermal capability relative to the thermal capacity of the heat load capacitor 68. For the relatively short period over which the cold working chamber 18 and regenerator 20 are in circuit with the low temperature heat exchanger 36 the system effective dead space is large. When directly coupled in this fashion the large dead volume of the heat exchanger substantially eliminates pressure fluctuations, as shown in FIG. 6. There need not be an asymmetrical relation between the decoupled interval, here used for discharging, and the coupled interval for all applications, because this is dependent on displacer dynamics. Instead, depending upon particular system requirements the length of the intermittent or periodic pause to provide charging of the heat load capacitor can be varied as desired. Furthermore, it will also be recognized that valve switching frequency can be assisted by temperature sensing of the heat load capacitors to control the limits of both charging and discharging, with switching taking place at minimum pressure points.

Figure 7:
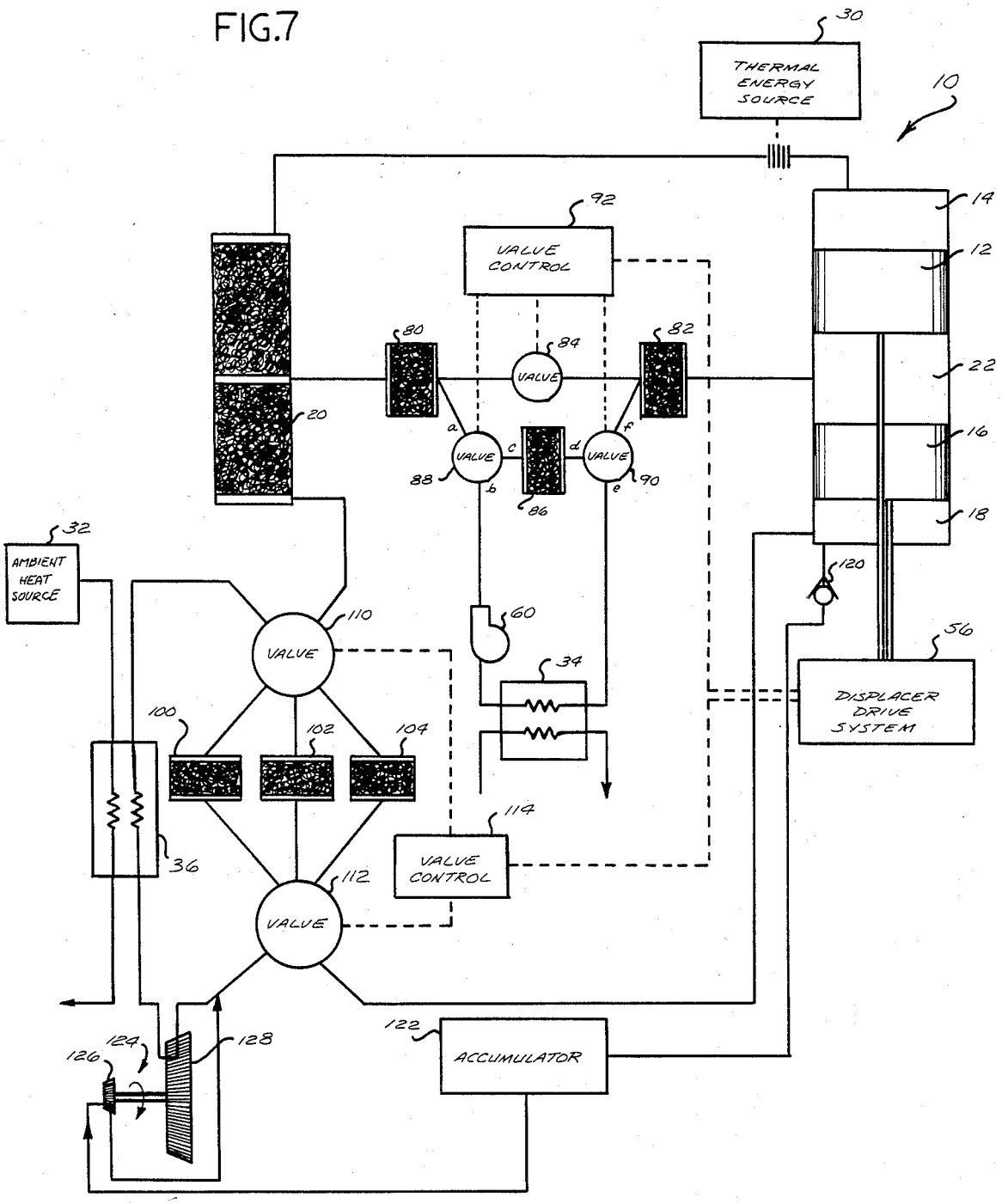
FIG. 7 is a schematic representation of a different system in accordance with the invention.

A number of combined other features of systems in accordance with the invention are illustrated jointly in the schematic diagram of FIG. 7, in which like reference numbers have been given to portions of the system that are the same or equivalent to the system of FIG. 1. In FIG. 7, two different heat load capacitor arrangements are shown in conjunction with different heat exchangers. This hybrid system is shown to demonstrate the versatility of the system and to provide a more concise description. In most instances, however, it would be preferred to use similar decoupling arrangements and like timing sequences in association with different heat exchangers in a system. A first heat load capacitor 80 and a second heat load capacitor 82 are coupled in series between the mid-region of the regenerator 20 and the intermediate temperature level working chamber 22, via an intermediate on-off valve 84. A third heat load capacitor 86 is coupled between the first and second heat load capacitors 80, 82, shunting the valve 84, via a pair of two position, three port valves 88, 90. All of the valves are controlled by a valve control 92 that is operated in synchronism with the displacer drive system 56 so as to maintain proper phase and frequency control. In one position of the second and third valves 88, 90, the ports b-c and d-e are open while the paths to the ports a and f are closed, and at the same time the series valve 84 is open. In this mode, the thermal load from pressure pulsations within the regenerator 20 and the intermediate level working chamber 22 charge the first and second heat load capacitors 80, 82, while the previously charged third heat load capacitor 86 is discharged through the intermediate level heat exchanger 34. Consequently, there is no coupling in this mode between the working fluid operating and the substantial dead space that includes the heat exchanger 34, even though thermal energy previously stored in the third heat load capacitor 86 is being discharged through the heat exchanger 34. To charge the third heat load capacitor 86, however, the valves 84, 88 and 90 are switched to the opposite position. In this position the ports b and e coupled to the heat exchanger 34 are closed and a path exists between the regenerator 20 and the intermediate level working chamber 22 via the first and second heat load capacitors 80, 82 and the third heat load capacitor 86. At this time the valve 84 is closed and the ports a-c and d-f in the valves 88, 90 respectively are connected. Pressure variations in the cycle charge the third heat load capacitor 86 from the thermal energy stored in the first and second heat load capacitors 80, 82, while the pressure cycle still remains isolated from the heat exchanger 34. Consequently, even though there is an intermittent or repetitive pause in the cycle, from the standpoint of transferring thermal energy to the heat exchanger 34, the dead space remains minimized.

It will also be evident, from the arrangement used in conjunction with the low temperature heat exchanger 36, that alternating charge and discharge paths can be utilized but that they need not be symmetrical. As also shown in FIG. 7, a different decoupling arrangement can be used in which first, second and third heat load capacitors are connected in parallel between first and second 3-position, 5-port valves 110, 112. Using conventional rotary, spool or linear valving devices, these valves 110, 112 provide a charging path from the heat exchanger 36 to any two of the three heat load capacitors 100, 102, 104 at a time. Concurrently a discharge path exists to the cold working chamber 18 through the remaining capacitor so that thermal energy is supplied to the working gas primarily coming from the cold end of the machine 10. Consequently, pressure cycle variations are decoupled from the external heat exchanger 36 and the apparent dead space is again minimized. The intercommunication paths are again controlled by a valve control 114 coupled to both of the valve devices 110, 112.

FIG. 7 also depicts a different arrangement for establishing circulation in the loop including the heat load capacitors and the low temperature heat exchanger 36. Pressurized working fluid for this system is derived intermittently through a one-way check valve 120 and stored in an accumulator 122 with a minor amount of continuous flow being bled off and supplied to the drive fan 126 of a turbine 124. An impeller 128 coupled into the circulation loop for the low temperature heat exchanger 36 then directs an adequate mass flow through the external circulation loop. Inasmuch as there is not a substantial pressure drop within this circulation loop, the self-energizing system provides a simple and reliable mechanism for maintaining constant flow.

Figure 8:
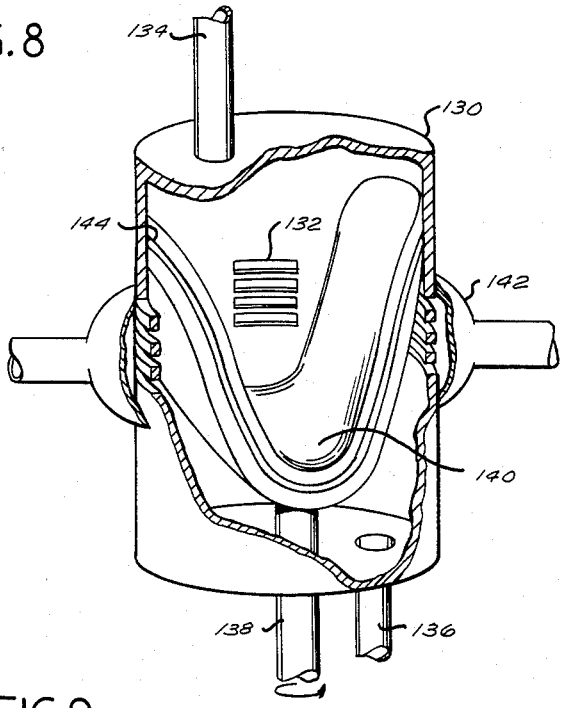
FIG. 8 is a perspective view, partially broken away, of a second valve type that may be employed in systems in accordance with the invention.
Figure 9:
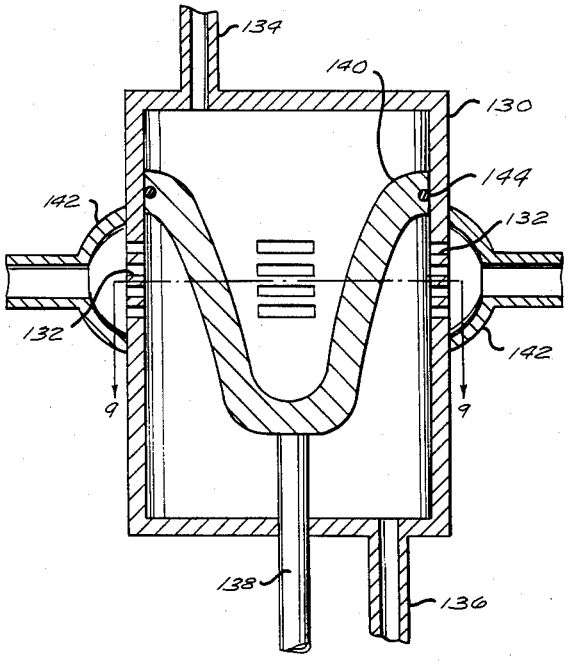
FIG. 9 is a side sectional view of the device of FIG. 8.
Figure 10:
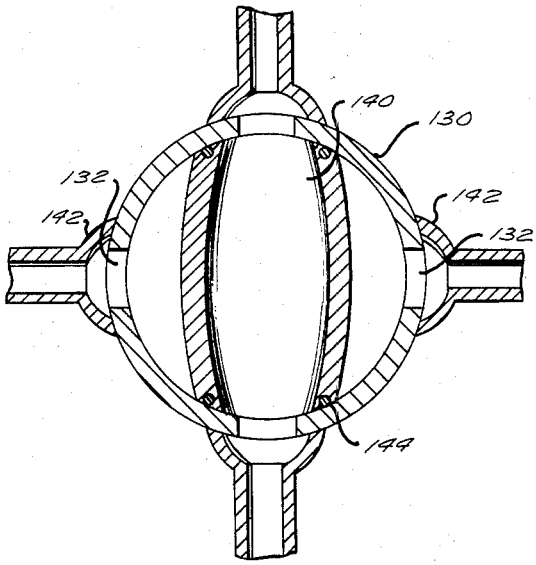
FIG. 10 is a top sectional view of the device of FIGS. 8 and 9, taking along the line 10—10 in FIG. 9 and looking in the direction of the appended arrows.

The valve device of FIG. 8 is particularly advantageous for providing the low void-space and low pressure-drop flow interconnections that are desired for systems in accordance with the present invention. Referring to FIGS. 8, 9 and 10, the rotary valve 130 is disposed within a cylindrical housing having four different sets of peripheral outlet ports 132 spaced in the quadrants on the periphery thereof. (One larger single port could be used in each quadrant). These are the internal ports for interconnection with the heat load capacitors in the system. External ports 134, 136 communicate with the top and the bottom of the cylindrical housing 130 respectively. A drive shaft 138 extending through an aperture in the bottom of the cylindrical housing 130 is coupled to rotate a saddle-shaped valve structure 140. The rotation may be continuous or in a succession of steps through 90° angles, for each valve shift. At each quadrant adjacent the ports 132 a header 142 or manifold is positioned to combine the flows from the separate apertures for that quadrant. Flows from opposed quadrants can be combined in the alternating heat load capacitor type of system. The valve body 140 is balanced for gas pressure side forces, and has an anticlastic or saddle shape, with a continuous periphery of generally sinusoidal form, in engagement with the interior cylindrical surface of the body 130 but with the maxima of the sinusoid being above each set of ports 132, and with the minima being below each set of ports. A continuous seal 144 is provided in the outer periphery of the saddle-shaped body, so as to insure against leakage between the body 140 and the inner housing wall.

In operation, the valving device of FIGS. 8–10 requires only movement of the valve body 140 through 90° angles to reverse the flow paths between the upper and lower ports 134, 136 and the respective side ports 132. In the position shown in FIG. 8, for example, the sets of ports 132 in the front and back of the Figure are in an open path with the top port 134 while the sets of ports 132 on the side of the Figure are in communication with the bottom port 136. Movement of the valve body 140 through a 90° angle reverses this relationship. Thus with a pair of heat load capacitors that are to be cross-coupled as shown in FIG. 1, two of these valve devices, shifted in 90° increments in synchronism, provide the cross-coupling function. The valves are compact and yet present only low pressure drop. They have adequately small mass and moment of inertia to be stepped 90° during each pressure cycle minima in the operation of a large heat pump, operating at a relatively slow rate of rotation. The stepping operation can be carried out considerably faster so that the changeover occurs at cycle minima for relatively high revolutions per minute. This is not necessary in most applications inasmuch as previously indicated a number of cycles can be utilized for each charging and discharging interval.

While a number of forms and variations have been discussed, it should be understood that the invention encompasses all modifications and expedients within the scope of the appended claims.

What is claimed is:

1. A thermodynamic system for interchanging thermal energy with external sources or sinks, comprising:

a thermodynamic machine including regenerator means, a working fluid, and means for cycling the working fluid bidirectionally through the regenerator means;

at least one heat exchanger for interchanging thermal energy with a heat source or sink, the heat exchanger including means for receiving working fluid therein; and switchable thermal energy storage means coupling working fluid between the regenerator means of the thermodynamic machine and the heat exchanger, the switchable thermal energy storage means isolating the thermodynamic machine from the heat exchanger for at least predetermined intervals during operation of the thermodynamic machine.

2. The invention as set forth in claim 1 above, wherein the thermodynamic machine operates in predetermined pressure-volume cycles, and wherein the thermal energy storage means transfers thermal energy between the heat exchanger and thermodynamic machine while reducing the dead volume presented to the thermodynamic machine.

3. The invention as set forth in claim 2 above, wherein the switchable thermal energy storage means comprises thermal regenerator means and controllable valve means coupling the working fluid in at least two circulation loops through the thermal energy storage means.

4. The invention as set forth in claim 3 above, wherein the system further includes control means responsive to the cycles of operation of the thermodynamic machine for switching at predetermined points related to the cycling of the thermodynamic machine.

5. The invention as set forth in claim 4 above, wherein the predetermined points in the cycling of the thermodynamic machine are pressure minima in the cycles.

6. The invention as set forth in claim 5 above, wherein the control means switches in synchronism with each full cycle of the thermodynamic machine.

7. The invention as set forth in claim 4 above, wherein the control means switches the thermal regenerator means in intervals comprising integral numbers of cycles of the thermodynamic machine.

8. The invention as set forth in claim 2 above, wherein the switchable thermal energy storage means comprises at least a pair of thermal energy storage means, and means for switching working fluid in alternate paths between the thermal energy storage means to provide complete isolation of the pressure cycle in the thermodynamic machine from the dead volume of the heat exchanger.

9. The invention as set forth in claim 8 above, wherein the thermal energy storage means comprises first and second heat load capacitors.

10. The invention as set forth in claim 8 above, wherein the thermal energy storage means comprises at least three heat load capacitors and means for switching at least one of the heat load capacitors in a circulation loop with the heat exchanger and at least one of the other heat load capacitors in a concurrent circulation loop with the thermodynamic machine.

11. The invention as set forth in claim 2 above, wherein the thermal energy storage means comprises thermal heat load capacitor means and the switchable thermal energy storage means isolates the thermodynamic machine from the heat exchanger for only predetermined intervals.

12. The invention as set forth in claim 11 above, wherein the heat load capacitor means comprises a single heat load capacitor, wherein the switchable means includes valve means, and means for alternately decoupling the thermodynamic machine from the heat exchanger while concurrently coupling the heat load capacitor into circuit with the thermodynamic machine, and thereafter coupling the heat load capacitor into circuit with both the heat exchanger and the thermodynamic machine.

13. The invention as set forth in claim 2 above, wherein the switchable thermal energy storage means comprises at least two heat load capacitor means and a controllable valve intercoupling the heat load capacitor means in at least two different circulating loops providing complete decoupling of the thermodynamic machine from the heat exchanger, with the heat exchanger being periodically excluded from a circulation loop.

14. The invention as set forth in claim 13 above, wherein there are three heat load capacitor means arranged in a series-shunt arrangement with two being in series with the thermodynamic machine and a third is in shunt with the series pair, and wherein the controllable valve means includes a first valve between the series pair and second and third valves between the third heat load capacitor means and each different one of the series pair, and means for controlling the valves to define a first mode of operation in which the series pair are in a circulation loop with the thermodynamic machine and the third heat load capacitor means is concurrently in a circulation loop with the heat exchanger, and a second mode in which the third heat load capacitor means is in series with the series pair and in a circulation loop with the thermodynamic machine while the heat exchanger is decoupled.

15. A thermodynamic system for interchanging thermal energy between the regenerator of a hot gas machine and a heat exchanger, comprising:

heat load capacitor means; and controllable valve means for intercoupling the heat load capacitor means between the hot gas machine and regenerator in one path and alternately with the heat exchanger in another path, whereby the regenerator and hot gas machine are decoupled from the heat exchanger for at least intervals during the operation of the hot gas machine, and the dead space presented by the heat exchanger to the hot gas machine and regenerator is reduced.

16. The invention as set forth in claim 15 above, wherein the heat load capacitor means comprise thermal regenerators.

17. The invention as set forth in claim 16 above, wherein the system further includes conduit means coupling the heat load capacitor means in said one path and alternately in said other path such that thermal energy stored in the capacitor means is interchanged between the two paths, and the controllable valve means comprises valve control means coupled to operate in synchronism with the hot gas machine for controlling the switching of the valve means.

18. The invention as set forth in claim 17 above, wherein the valve means are switched at an integral number of cycles of the hot gas machine equal to or greater than 1.

19. The invention as set forth in claim 18 above, wherein the valves are switched at low pressure points in the pressure swings of the hot gas machine.

20. The invention as set forth in claim 19 above, further including means coupled to the conduit means and the external heat exchanger for driving working fluid through the heat load capacitor means in the circulation path coupled to the heat exchanger.

21. The invention as set forth in claim 20 above, wherein the heat load capacitor means comprises a single thermal regenerator and the heat exchanger is periodically decoupled from and then coupled to the regenerator and hot gas machine.

22. The invention as set forth in claim 20 above, wherein the heat load capacitor means comprise at least a pair of thermal regenerators and the valve means establish alternating paths of circulation such that the heat exchanger is fully decoupled from the hot gas machine.

23. The invention as set forth in claim 20 above, wherein the heat load capacitor means comprises at least two thermal regenerators and the controllable valve means defines alternate series and shunt paths through said regenerators, with at least one thermal regenerator being in circuit with the hot gas machine while at least one is in separate circuit with the heat exchanger in one mode, while the at least two thermal regenerators are in circuit with the hot gas machine and decoupled from the heat exchanger in another mode.

24. A thermodynamic machine comprising:

means defining a hot gas working chamber and a cold gas working chamber, said thermodynamic machine further including a hot displacer and a cold displacer and means for cycling the hot and cold displacers in phased relation;

regenerator means coupled between the hot working chamber and cold working chamber;

means supplying thermal energy to heat the hot working chamber;

at least one heat exchanger; and means coupling at least one selected region of the regenerator to the heat exchanger, said means including means for decoupling the pressure cycle of the thermodynamic machine from the heat exchanger and means for interchanging thermal energy from the working fluid therewith.

25. The invention as set forth in claim 24 above, wherein said means for exchanging thermal energy therewith comprises heat load capacitor means and controllable valve means for coupling the heat load capacitor means into different communication paths between the regenerator means and the heat exchanger, such that thermal energy is transferred between the regenerator means and the heat exchanger.

26. The invention as set forth in claim 25 above, further including means coupled to operate in synchronism with the cycling of the thermodynamic machine for controlling the switching of the heat load capacitor means.

27. The invention as set forth in claim 26 above, wherein the thermodynamic machine further includes an intermediate temperature level working chamber, and wherein the heat load capacitor means is alternately coupled to an intermediate temperature level portion of the regenerator.

28. The invention as set forth in claim 27 above, wherein the system further includes a second heat exchanger, a second heat load capacitor means, and second controllable valve means intercoupling the second heat load capacitor means in alternate paths to the second heat exchanger and the cold end of the regenerator.

29. The invention as set forth in claim 28 above, wherein in addition the system includes means for pumping working fluid through each of the heat exchangers and the associated heat load capacitor means.

30. The invention as set forth in claim 29 above, wherein the means for pumping comprises turbine means in the heat exchanger path and means including accumulator means and conduit means communicating with a working chamber of the machine for driving the turbine means.

31. The method of interchanging thermal energy communicated by a working fluid exchanged between a hot gas machine and a heat exchanger while reducing the dead volume normally presented by the heat exchanger comprising the steps of passing the working fluid from one device for a period of time in a first path that returns to the one device while storing the thermal energy from the one device, and thereafter transferring the previously stored thermal energy to the other device by passage of working fluid via a second path that circulates working fluid with the second device, and decoupling the hot gas machine from the heat exchanger for at least successive intervals during operation.

32. The method as set forth in claim 31 above, wherein thermal energy is stored in one path while concurrently being transferred in the other, and the functions of the two paths are thereafter reversed such that substantially continuous operation and full decoupling are provided.

33. The method as set forth in claim 31 above, wherein the thermal energy storage is time shared in the two paths and the heat exchanger and hot gas machine are periodically decoupled.

34. The method as set forth in claim 31 above, including in addition the step of transferring stored thermal energy for further storage, and interchanging the energy with the further storage whereby full decoupling is provided with indirect energy transfer.

* * * * *